US005254795A

United States Patent [19]

Boucher et al.

[11] Patent Number: 5,254,795

[45] Date of Patent: Oct. 19, 1993

[54] REMOVAL OF 2-RING AROMATICS FROM LOW BOILING STREAMS CONTAINING LOW CONCENTRATIONS OF SAME USING MEMBRANES

[75] Inventors: Heather A. Boucher, Point Edward; Donald T. MacGregor, Sarnia, both of Canada

[73] Assignee: Exxon Research and Engineering Company, Florham Park, N.J.

[21] Appl. No.: 957,118

[22] Filed: Oct. 7, 1992

[51] Int. Cl.[5] ..... C07C 7/144; B01D 61/00

[52] U.S. Cl. ..... 585/819; 208/308; 210/651

[58] Field of Search ..... 585/819; 208/308; 210/651

[56] References Cited

U.S. PATENT DOCUMENTS

| | | | |
|---|---|---|---|
| 2,930,754 | 3/1960 | Stuckey | 210/23 |
| 2,958,656 | 11/1960 | Stuckey | 210/23 |
| 3,370,102 | 2/1968 | Carpenter et al. | 260/674 |
| 4,115,465 | 9/1978 | Elfert et al. | 260/674 |
| 4,828,773 | 5/1989 | Feimer et al. | 264/45.5 |
| 4,837,054 | 6/1989 | Schucker | 427/244 |
| 4,861,628 | 8/1989 | Schucher | 502/4 |
| 4,879,044 | 11/1989 | Feimer et al. | 210/654 |
| 4,914,064 | 4/1990 | Schucker | 502/4 |
| 4,929,358 | 5/1990 | Koenitzer | 210/640 |
| 4,944,880 | 7/1990 | Ho et al. | 210/500.39 |
| 4,946,594 | 8/1990 | Thaler et al. | 210/651 |
| 4,962,270 | 10/1990 | Feimer et al. | 585/819 |
| 4,962,271 | 10/1990 | Black et al. | 585/819 |
| 4,976,868 | 12/1990 | Sartori et al. | 210/640 |
| 4,990,275 | 2/1991 | Ho et al. | 252/62.3 |
| 5,045,206 | 9/1991 | Chen et al. | 585/819 |

FOREIGN PATENT DOCUMENTS

| | | |
|---|---|---|
| 0312375 | 4/1989 | European Pat. Off. . |
| 0312376 | 4/1989 | European Pat. Off. . |
| 3235328 | 9/1988 | Japan . |

*Primary Examiner*—Anthony McFarlane
*Assistant Examiner*—Nhat D. Phan
*Attorney, Agent, or Firm*—Joseph J. Allocca

[57] ABSTRACT

Straight run hydrocarbon distillate streams containing low concentrations of 2-ring aromatics can be processed to remove a high percentage of the 2-ring aromatics by contacting said stream with one side of a polyester imide membrane under pervaporation conditions to produce a permeate stream containing a very high percentage of 2-ring aromatics and a retentate stream of severely reduced 2-ring aromatic content.

5 Claims, No Drawings

REMOVAL OF 2-RING AROMATICS FROM LOW BOILING STREAMS CONTAINING LOW CONCENTRATIONS OF SAME USING MEMBRANES

BACKGROUND OF THE INVENTION

1. Field of the Invention

The present invention is a process for the very selective removal of 2-ring aromatics from straight run hydrocarbon distillate feed streams which contain low concentrations of 2-ring aromatics said process comprising contacting said hydrocarbon feed stream with one side of a polyester imide membrane under pervaporation conditions thereby permeating a high percentage of the 2-ring aromatics in the feed across the membrane resulting in the production of a permeate enriched in 2-ring aromatics and a retentate of severely reduced 2-ring aromatics content as compared to the hydrocarbon feed.

2. Description of the Related Art

The separation of aromatics from hydrocarbon streams comprising mixtures of aromatic and non-aromatic hydrocarbons using membranes is a process well documented in the literature.

U.S. Pat. No. 3,370,102 describes a general process for separating a feed into a permeate stream and a retentate stream and utilizes a sweep liquid to remove the permeate from the face of the membrane to thereby maintain the concentration gradient driving force. The process can be used to separate a wide variety of mixtures including various petroleum fractions, naphthas, oils, hydrocarbon mixtures. Expressly recited is the separation of aromatics from kerosene.

U.S. Pat. No. 2,958,656 teaches the separation of hydrocarbons by type, i.e., aromatics, unsaturated, saturated, by permeating a portion of the mixture through a non-porous cellulose ether membrane and removing permeate from the permeate side of the membrane using a sweep gas or liquid. Feeds include hydrocarbon mixtures, e.g., naphtha (including virgin naphtha, naphtha from thermal or catalytic cracking, etc.).

U.S. Pat. No. 2,930,754 teaches a method for separating hydrocarbons, e.g., aromatic and/or olefins from gasoline boiling range mixtures, by the selective permeation of the aromatic through certain non-porous cellulose ester membranes. The permeated hydrocarbons are continuously removed from the permeate zone using a sweep gas or liquid.

U.S. Pat. No. 4,115,465 teaches the use of polyurethane membranes to selectively separate aromatics from saturates via pervaporation.

Compared to distillation, membrane permeation can lead to considerable energy savings. A membrane can separate a mixture of aromatics and saturates, e.g., a heavy cat naphtha, into a highoctane, mainly aromatic permeate and a high-cetane, mainly saturated retentate. Both permeate and retentate are more valuable than the starting heavy cat naphtha.

Polyurea/urethane membranes and their use for the separation of aromatics from non-aromatics are the subject of U.S. Pat. No. 4,914,064. In that case the polyurea/urethane membrane is made from a polyurea/urethane polymer characterized by possessing a urea index of at least about 20% but less than 100%, an aromatic carbon content of at least about 15 mole percent, a functional group density of at least about 10 per 100 grams of polymer, and a C-O/NH ratio of less than about 8.0. The polyurea/urethane multi-block copolymer is produced by reacting dihydroxy or polyhydroxy compounds, such as polyethers or polyesters having molecular weights in the range of about 500 to 5,000 with aliphatic, alkylaromatic or aromatic diisocyanates to produce a prepolymer which is then chain extended using diamines, polyamines or amino alcohols. The membranes are used to separate aromatics from non-aromatics under perstraction or pervaporation conditions.

The use of polyurethane imide membranes for aromatics from non-aromatics separations is disclosed in U.S. Pat. No. 4,929,358. The polyurethane imide membrane is made from a polyurethane imide copolymer produced by end capping a polyol such as a dihydroxy or polyhydroxy compound (e.g., polyether or polyester) with a di or polyisocyanate to produce a prepolymer which is then chain extended by reaction of said prepolymer with a di or polyanhydride or with a di or polycarboxylic acid to produce a polyurethane/imide. The aromatic/-non-aromatic separation using said membrane is preferably conducted under perstraction or pervaporation conditions.

A polyester imide copolymer membrane and its use for the separation of aromatics from non-aromatics is the subject of U.S. Pat. No. 4,946,594. In that case the polyester imide is prepared by reacting polyester diol or polyol with a dianhydride to produce a prepolymer which is then chain extended preferably with a diisocyanate to produce the polyester imide.

U.S. Pat. No. 4,962,271 teaches the membrane separation under perstraction conditions of a distillate to produce a retentate rich in non-aromatics and alkyl-single ring aromatics and a permeate rich in multi-ring aromatics. The multi-ring aromatics recovered in the permeate are alkyl substituted and alkyl/hetero-atom substituted multi-ring aromatic hydrocarbons having less than 75 mole % aromatic carbon. The multi-ring aromatics are 2-,3-,4-ring and fused multi-ring aromatics.

U.S. Pat. No. 4,944,880 teaches polyester imide membranes and their use for the separation of aromatic hydrocarbons from feeds comprising mixtures of aromatic and non-aromatic hydrocarbons. The polyester imide membranes are described as being produced from a copolymer composition comprising a hard segment of polyimide and a soft segment of an oligomeric aliphatic polyester wherein the polyimide is derived from a dianhydride having between 8 and 20 carbon atoms and a diamine having between 2 and 30 carbon atoms and the oligomeric aliphatic polyester is a polyadipate, a polysuccinate, a polymalonate, a polyoxalate or a polyglutarate. The separation of aromatics from non-aromatics may be conducted under perstraction or pervaporation conditions. The hydrocarbon feed streams can be selected from heavy cat naphtha, intermediate cat naphtha, light aromatics content streams boiling in the $C_5$-150° C. range, light cat cycle oil boiling in the 200° to 345° C. range as well as streams in chemical plants which contain recoverable quantities of benzene, toluene, xylene or other aromatics in combination with saturates.

These separations have involved the bulk separation of large amounts of aromatics from hydrocarbon streams which contained high concentrations of aromatics of various types. No one aromatic or aromatic type is enriched in the permeate to a very large degree relative to the other aromatics present in the permeate.

It would be extremely useful if trace or very low concentrations of specific aromatic components present in hydrocarbon streams could be selectively removed from such streams without resorting to exotic solvents in solvent extraction or complicated extractiondistillation processes. It would be especially attractive if such separations could be accomplished in a non-energy intensive manner such as membrane separation,

BRIEF DESCRIPTION OF THE INVENTION

Two-ring aromatics and $C_1$–$C_2$ substituted 2-ring aromatics are removed with very high selectivity from low boiling straight run hydrocarbon distillate streams in which they are present in trace or low-concentration quantities by the permeation of said 2-ring aromatics under pervaporation conditions through a membrane such as a polyester imide.

DESCRIPTION OF THE PREFERRED EMBODIMENT

Environmentally undesirable 2-ring aromatics present in low concentrations in hydrocarbon distillate streams are removable from said streams by selective permeation of the 2-ring aromatics through a polyester imide membrane under pervaporation conditions.

As the expression is used in this text and the appended claims, very selective permeation of 2-ring aromatics means that the concentration of 2-ring aromatics in the permeate is much greater than that in the feed. 2-ring aromatics are the only aromatic components which are permeated very selectively. In particular, the ratio of the permeate 2-ring aromatics concentration to the feed 2-ring aromatics concentration is more than a factor of 5 greater than that ratio for any single ring aromatic component in the feed.

The straight run hydrocarbon distillate feeds treated by the process of the present application contain about 40 wt% or less total aromatics, preferably about 20 wt% or less total aromatics, while containing about 3 wt% or less 2-ring aromatics, preferably about 2 wt% or less 2-ring aromatics, more preferably about 1 wt% or less 2-ring aromatics, most preferably less than 0.5 wt% 2-ring aromatics.

In removing the small quantities of 2-ring aromatics present in the feed, only about 2–5 wt.% of the feed would need to be permeated because of the exceptionally high selectivity of the membranes to 2-ring aromatics when 2-ring aromatics are present in extremely low concentrations in the feed. The very high selectivity for naphthalenes thus has very considerable economic advantages.

For the purposes of the specification and the appended claims the term 2-ring aromatics is understood to include naphthalene and $C_1$–$C_2$ naphthalene either individually or in combination.

In performing the selective 2-ring aromatics separation the membranes employed are polyester imide membranes.

These membranes are disclosed in U.S. Pat. No. 4,944,880 and U.S. Pat. No. 4,990,275.

The hydrocarbon feed stream containing low/trace concentrations of naphthalenes is described, for the purposes of this specification and the appended claims, as being a straight run hydrocarbon atmospheric or vacuum distillate. Suitable atmospheric distillate cuts are those boiling in the range of 100° to 400° F., preferably 150° to 300° F. while suitable vacuum distillate cuts are those boiling in the 200° to 500° F. range, preferably 250° to 450° F. range. This distinguishes the present feed from other hydrocarbon streams containing low naphthalene concentrations which have been catalytically processed, such as cat naphtha, which feeds when contacted with a polyester imide membrane do not permeate the naphthalene with very high selectivity as compared to other aromatic components present in the stream.

In the past, it has been seen and has come to be expected that aromatics and non-aromatics can be separated by the permeation of the aromatics component in a feed through a membrane such as the polyester imides. Different aromatic species, of course, permeate with different selectivities, but the selectivity factor for all aromatics usually fell in the range of 5–15, and differed from one another by no more than a factor of 2 to 3.

It has also come to be expected that the higher the concentration of any one aromatic component in the feed, the greater is the tendency of that component to permeate through the membrane. This follows from the thermodynamic concept of activity coefficient, which is related to a component's concentration. The greater the activity coefficient of a feed component, the greater its driving force to permeate through the membrane.

It has thus come to be expected that the greater the concentration of an aromatic component in the feed, the greater will be its concentration in the permeate. Conversely, the lower the concentration of a feed aromatic component, the lower will be its activity coefficient and its driving force for permeation. Such a component would be expected to have a low concentration in the permeate.

It has now been discovered that, surprisingly and quite contrary to conventional expectations, 2-ring aromatics present in straight run hydrocarbon distillate streams in very low concentrations can be permeated through polyester imide membrane with a selectivity factor greater than 10 preferably greater than 50 and even exceeding 100.

Membrane selectivity is gauged by use of the selectivity factor which compares the aromatics/saturates ratio of the permeate to that of the feed. The selectivity factor can become very large simply because the saturate concentration in the permeate has become very small. To better define the selectivity of a membrane relative to individual components in the feed it is proposed that the enrichment factor be considered. The enrichment factor is simply the factor by which a component's concentration is increased in the permeate relative to the component's concentration in the feed. Thus, if component A makes up 0.1% of the feed but 10% of the permeate, the enrichment factor is 100. This is a more absolute gauge of the ability of a membrane to selectively permeate specific species within the feed and a gauge of a membrane's ability to distinguish between specific components.

Expressed in terms of enrichment factor, the 2-ring aromatics fraction of the permeate compared to the 2-ring aromatics concentration in the feed is enriched by a factor of from 30 to 100 by the practice of the present invention. This is not to be interpreted as just indicating that 2-ring aromatics are separated from a feed with very high selectivity, but rather that 2-ring aromatics are the only species which are separated with a very high selectivity. Thus, the enrichment factor for 2-ring aromatics are more than a factor of 5 greater than that of any single ring aromatic component in the feed.

For 2-ring aromatics to be separated with such a very high selectivity, it is necessary that the feed be a straight run distillate stream, that the 2-ring aromatics concentration be low, and a selective membrane such as polyester imide be used.

The process of the present invention is practiced under pervaporation conditions. The feed is in either the liquid or vapor state. The process relies on vacuum or sweep gas on the permeate side to evaporate or otherwise remove the permeate from the surface of the membrane. Pervaporation process can be performed at a temperature of from about 25° to 200° C. and higher, the maximum temperature being that temperature at which the membrane is physically damaged.

The pervaporation process also generally relies on vacuum on the permeate side to evaporate the permeate from the surface of the membrane and maintain the concentration gradient driving force which drives the separation process. The maximum temperature employed in pervaporation will be that necessary to vaporize the components in the feed which one desires to selectively permeate through the membrane while still being below the temperature at which the membrane is physically damaged. While a vacuum may be pulled on the permeate side operation at atmospheric pressure on the permeate side is also possible and economically preferable. In pervaporation it is important that the permeate evaporate from the downstream side (permeate side) of the membrane. This can be accomplished by either decreasing the permeate pressure (i.e. pulling a vacuum) if the permeate boiling point is higher than the membrane operating temperature or by increasing the membrane operating temperature above the boiling point of the permeate in which case the permeate side of the membrane can be at atmospheric pressure. This second option is possible when one uses a membrane capable of functioning at very high temperature. In some cases if the membrane operating temperature is greater than the boiling point of the permeate the permeate side pressure can be greater than 1 atmosphere. The stream containing the permeate is cooled to condense out the permeated product. Condensation temperature should be below the dew point of the permeate at a given pressure level.

The membranes can be used in any convenient form such as sheets, tubes or hollow fibers. Sheets can be used to fabricate spiral wound modules familiar to those skilled in the art.

An improved spiral wound element is disclosed in copending application USSN 921,872 filed Jul. 29, 1992 wherein one or more layers of material are used as the feed spacer, said material having an open cross-sectional area of at least 30 to 70% and wherein at least three layers of material are used to produce the permeate spacer characterized in that the outer permeate spacer layers are support layers of a fine mesh material having an open cross-sectional area of about 10 to 50% and a coarse layer having an open cross-sectional area of about 50 to 90% is interposed between the aforesaid fine outer layers, wherein the fine layers are the layers in interface contact with the membrane layers enclosing the permeate spacer. While the permeate spacer comprises at least 3 layers, preferably 5 to 7 layers of alternating fine and coarse materials are used, fine layers always being the outer layers. In a further improvement an additional woven or non-woven chemically and thermally inert sheet may be interposed between the membrane and the multi-layer spacers, said sheet being for example a sheet of Nomex about 1 to 15 mils thick.

Alternatively, sheets can be used to fabricate a flat stack permeator comprising a multitude of membrane layers alternately separated by feed-retentate spacers and permeate spacers. The layers are glued along their edges to define separate feed-retentate zones and permeate zones. This device is described and claimed in U.S. Pat. No. 5,104,532.

Tubes can be used in the form of multi-leaf modules wherein each tube is flattened and placed in parallel with other flattened tubes. Internally each tube contains a spacer. Adjacent pairs of flattened tubes are separated by layers of spacer material. The flattened tubes with positioned spacer material is fitted into a pressure resistant housing equipped with fluid entrance and exit means. The ends of the tubes are clamped to create separate interior and exterior zones relative to the tubes in the housing. Apparatus of this type is described and claimed in U.S. Pat. No. 4,761,229.

Hollow fibers can be employed in bundled arrays potted at either end to form tube sheets and fitted into a pressure vessel thereby isolating the insides of the tubes from the outsides of the tubes. Apparatus of this type are known in the art. A modification of the standard design involves dividing the hollow fiber bundle into separate zones by use of baffles which redirect fluid flow on the tube side of the bundle and prevent fluid channelling and polarization on the tube side. This modification is disclosed and claimed in USSN 423,178 filed Oct. 18, 1989, now abandoned.

Preferably the direction of flow in a hollow fiber element will be counter-current rather than co-current or even transverse. Such counter-current flow can be achieved by wrapping the hollow fiber bundle in a spiral wrap of flow-impeding material. This spiral wrap extends from a central mandrel at the center of the bundle and spirals outward to the outer periphery of the bundle. The spiral wrap contains holes along the top and bottom ends whereby fluid entering the bundle for tube side flow at one end is partitioned by passage through the holes and forced to flow parallel to the hollow fiber down the channel created by the spiral wrap. This flow direction is counter-current to the direction of flow inside the hollow fiber. At the bottom of the channels the fluid re-emerges from the hollow fiber bundle through the holes at the opposite end of the spiral wrap and is directed out of the module. This device is disclosed and claimed in copending application USSN 802,158 filed Dec. 4, 1991.

The membranes employed in the present invention are generally described as polyester imide membranes and are described and claimed in U.S. Pat. No. 4,944,880 and U.S. Pat. No. 4,990,275.

The polyester imide membranes are made from a copolymer comprising a polyimide segment and an oligomeric aliphatic polyester segment, the polyimide being derived from a dianhydride having between 8 and 20 carbons and a diamine having between 2 and 30 carbons and the oligomeric aliphatic polyester being a polyadipate, a polysuccinate, a polymalonate, a polyoxalate or a polyglutarate. Alternately, an activated anhydride acid such as terphthalic anhydride acid chloride may be used.

The diamines which can be used include phenylene diamine, methylene dianiline (MDA), methylene di-o-chloroaniline (MOCA), methylene bis (dichloroaniline) (tetrachloro MDA), methylene dicyclohexylamine ($H_{12}$-MDA), methylene dichlorocyclohexylamine ($H_{12}$MOCA), methylene bis (dichlorocyclohexylamine) (tetrachloro $H_{12}$MDA), 4,4'-(hexafluoroisopropylidene)-bisaniline (6F diamine), 3,3'-diaminophenyl sulfone (3,3' DAPSON), 4,4'-diaminophenyl sulfone (4,4' DAPSON), 4,4'-dimethyl-3,3'-diaminophenyl sulfone (4,4'-dimethyl-3,3' DAPSON), 2,4-diamino cumene, methyl bis(di-o-toluidine), oxydianiline (ODA), bisaniline A, bisaniline M, bisaniline P, thiodianiline, 2,2-bis[4-(4-aminophenoxy) phenyl] propane (BAPP), bis[4-(4-aminophenoxy phenyl) sulfone (BAPS), 4,4'-bis(4-aminophenoxy) biphenyl (BAPB), 1,4-bis(4-aminophenoxy) benzene (TPE-Q), and 1,3-bis(4-aminophenoxy) benzene (TPE-R).

The dianhydride is preferably an aromatic dianhydride and is most preferably selected from the group consisting of pyromellitic dianhydride, 3,3',4,4'-benzophenone tetracarboxylic dianhydride, 4,4'-(hexafluoroisopropylidene)- bis(phthalic anhydride), 4,4'-oxydiphthalic anhydride, diphenylsulfone-3,3',4,4'-tetracarboxylic dianhydride, and 3,3',4,4'-biphenyl-tetracarboxylic dianhydride.

Examples of preferred polyesters include polyethylene adipate and polyethylene succinate.

The polyesters used generally have molecular weights in the range of 500 to 4000, preferably 1000 to 2000.

In practice the membrane may be synthesized as follows. One mole of a polyester, e.g. polyadipate, polysuccinate, polyoxalate, polyglutarate or polymalonate, preferably polyethylene adipate or polyethylene succinate, is reacted with two moles of the dianhydride, e.g. pyromellitic dianhydride, to make a prepolymer in the endcapping step. One mole of this prepolymer is then reacted with one mole of diamine, e.g. methylene di-o-chloroaniline (MOCA) to make a copolymer. Finally, heating of the copolymer at 260°-300° C. for about ½ hour leads to the copolymer containing polyester and polyimide segments. The heating step converts the polyamic acid to the corresponding polyimide via imide ring closure with removal of water.

In the synthesis an aprotic solvent such as dimethylformamide (DMF) is used in the chain-extension step. DMF is a preferred solvent but other aprotic solvents are suitable and may be used. A concentrated solution of the polyamic acid/polyester copolymer in the solvent is obtained. This solution is used to cast the membrane. The solution is spread on a glass plate or a high temperature porous support backing, the layer thickness being adjusted by means of a casting knife. The membrane is first dried at room temperature to remove most of the solvent, then at 120° C. overnight. If the membrane is cast on a glass plate it is removed from the casting plate by soaking in water. If cast on a porous support backing it is left as is. Finally, heating the membrane at 300° C. for about 0.5 hours results in the formation of the polyimide. Obviously, heating to 300° C. requires that if a backing is used the backing be thermally stable, such as teflon, fiber glass, sintered metal or ceramic or high temperature polymer backing.

The invention is further demonstrated by the following non-limiting examples.

EXAMPLE 1

Two different membranes were evaluated for their ability to selectively remove naphthalene from a hydrofined straight run hydrocarbon vacuum distillate boiling in the 320°-390° F. range available under the tradename Varsol. The membranes which were compared were a polyurea/urethane and a polysuccinate imide.

The polyurea/urethane membrane consisted of 2 layers. The first was prepared from a 30/70 weight ratio of 2000 and 500 molecular weight polyethylene adipate endcapped with methylene diisocyanate and chain extended with 4,4'-methylenedianiline in dimethylformamide the components being used in a 1:2:1 mole ratio. It was cast onto a porous teflon support with nominal 0.1 micron pores, 75% porosity on a non-woven nomex/polyethylene terephthalate backing, (Gore K-150 Teflon) and dried at 100° C. for 1 hour. A second polymer solution was prepared using only 2000 molecular weight polyethylene adipate and was cast on top of the first layer and dried at 100° C. for 1 hour.

The polyester (succinate) imide membrane was prepared from 2000 molecular weight polyethylene succinate endcapped with pyromellitic anhydride and chain extended with 4,4'-methylenedianiline in an acetone/dimethylformamide mixture the components being used in a 1:2:1 mole ratio. The polymer was cast onto a porous teflon support (as previously described), then dried and cured at 270° C. for 12 minutes. After curing, a second coat was applied and was cured similarly.

An analysis of the feed composition, permeate composition and conditions employed in the separation are presented in Table 1.

TABLE 1

AROMATIC REMOVAL FROM VARSOL USING A PERVAPORATION PROCESS

| Membrane | Feed | Polyurea-Urethane Permeate | Enrichment Factor | Feed | Poly(succinate) imide Permeate | Enrichment Factor |
|---|---|---|---|---|---|---|
| Wt % Component: | | | | | | |
| Benzene | 0.1 | 0.1 | 1.0 | 0.2 | 0.3 | 1.5 |
| Toluene | 0.3 | 0.4 | 1.3 | 0.5 | 1.1 | 2.2 |
| C8 Benzenes | 2.3 | 4.0 | 1.7 | 1.6 | 2.4 | 1.5 |
| C9 Benzenes | 8.7 | 12.5 | 1.4 | 8.9 | 13.2 | 1.5 |
| C10 Benzenes | 6.2 | 7.6 | 1.2 | 6.9 | 20.3 | 2.9 |
| C11 Benzenes | 2.2 | 2.4 | 1.1 | 2.6 | 8.3 | 3.2 |
| Naphthalenes | 0.3 | 0.4 | 1.3 | 0.1 | 5.2 | 52.0 |
| Indanes | 1.4 | 1.7 | 1.2 | 1.4 | 4.9 | 3.5 |
| Paraffins | 36.2 | 28.6 | — | 32.6 | 17.8 | — |
| Naphthenes | 32.2 | 32.7 | 1.0 | 35.1 | 18.2 | — |
| Condensed Naphthenes | 10.1 | 9.7 | — | 10.2 | 8.2 | — |
| Total Aromatics | 21.5 | 29.0 | 1.3 | 22.1 | 55.8 | 2.5 |
| Flux, Kg/m2Day | | 4.4–20 | | 27 | | |
| Temperature, °C. | | 100 | | 150 | | |
| Pressure, mBar | | 13–14 | | 10 | | |
| Thickness, microns | | 7–8 | | 1.0 | | |

TABLE 1-continued

AROMATIC REMOVAL FROM VARSOL USING A PERVAPORATION PROCESS

| Membrane | Feed | Polyurea-Urethane Permeate | Enrichment Factor | Feed | Poly(succinate) imide Permeate | Enrichment Factor |
|---|---|---|---|---|---|---|
| Wt % yield | | 2.1 | | 1.0 | | |

It is seen that use of the polyester (succinate) imide membrane gave a 52-fold increase (enrichment factor 52) in the naphthalenes concentration (selectively factor 92) in the permeate. The polyurethane membrane gave only a 33% increase (enrichment factor 1.3, selectivity factor 4) in naphthalenes concentration. None of the other aromatic components permeated through the polyester (succinate) imide membrane to such a high degree or to as high a level of selectivity. The enrichment factor for any other component is 3.5 or less with the same membrane. This is especially unexpected in view of the fact that naphthalenes were present in such a low concentration in the feed. Because of the low concentration of naphthalenes in the feed one would have expected only a proportional amount of naphthalenes to appear in the permeate. The results obtained with the polyester (succinate) imide membrane go against the generally accepted precept that aromatics permeate through membranes under the influence of a concentration gradient and, therefore, the higher the concentration of any one species in the feed, the greater the tendency to permeate through the membrane. Conversely, species present in low concentration should experience minimal driving force and, therefore, appear in low concentrations in the permeate.

Such is not the case with feeds of low naphthalenes concentration subjected to pervaporation through a polyester imide membrane. Naphthalenes are permeated with high selectivity and high enrichment factors even if very little of those species is present in the feed.

Note that higher temperatures could be used with the polyester (succinate) imide membrane than with the polyurea/urethane membrane, resulting in higher fluxes for the former. Normally, when flux increases selectivity decreases. In spite of the use of higher temperature, however, selectivity was much higher for the polyester (succinate) imide membrane.

EXAMPLE 2

The previous example showed that with respect to naphthalenes selectivity the polyester imide membrane is surprisingly more selective than the polyurea/urethane membrane. The following example shows that the nature of the feed also influences the naphthalene selectivity of the separation, even when using polyester imide membranes.

A heavy cat naphtha was subjected to pervaporative separation using a polyester (adipate) imide membrane.

The membrane was prepared using a 1:2:1 molar ratio of polyethylene adipate, pyromellitic dianhydride and methylenedianiline in DMF/acetone solution. It was cast on the previously described teflon backing (Gore K-150 Teflon) dried at 200° F. for 4.5 minutes and cured at 450° F. for 7.5 minutes to convert it to the imide form. The membrane was 5 microns thick.

Table 2 presents a feed analysis and the analysis of permeate streams recovered at three different permeate yields.

TABLE 2

AROMATICS REMOVAL FROM AN HCN USING A POLYESTER (ADIPATE) IMIDE MEMBRANE UNDER PERVAPORATION CONDITIONS

| | FEED | PERMEATE 1 | PERMEATE 2 | PERMEATE 3 |
|---|---|---|---|---|
| Wt % Component: | | | | |
| Benzene | 0 | 0 | 0 | 0 |
| Toluene | 0 | 0 | 0 | 0 |
| C8 Benzenes | 3.4 | 6.0 | 4.9 | 3.7 |
| C9 Benzenes | 11.6 | 20.8 | 17.4 | 11.4 |
| C10 Benzenes | 15.8 | 21.4 | 22.2 | 18.6 |
| C11 Benzenes | 6.2 | 6.8 | 7.7 | 7.6 |
| C12 Benzenes | 1.1 | 0.6 | 0.7 | 1.2 |
| Naphthalenes | 2.1 | 5.1 | 3.7 | 1.4 |
| Indanes | 14.0 | 20.1 | 18.8 | 14.4 |
| Paraffins | 20.9 | 7.1 | 9.5 | 18.1 |
| Naphthenes | 12.9 | 6.4 | 8.0 | 12.3 |
| Olefins | 12.0 | 5.7 | 6.9 | 11.2 |
| Total Aromatics | 54.2 | 80.8 | 75.4 | 58.3 |

Pervaporation was conducted at 140° C., 7 mm Hg. Selectivity factors are relatively low in this case for all aromatics. The selectivity factors for naphthalene removal for the three permeates were 4.0, 2.4 and 0.68 relative to total saturates in the feed.

These separations are those expected using a polyester imide membrane and a feed which has previously been subjected to a hydroconversion process such as catalytic cracking. No one component is separation with very high selectivity.

EXAMPLE 3

The importance of using a feed with low aromatics concentration is demonstrated in this Example. A gas oil which is a straight run distillate was used as feed to a pervaporation process using a polyester (succinate) membrane. The results, conditions employed, and feed/permeate compositions are presented in Table 3.

The membrane polymer was prepared from 1670 molecular weight polyester (succinate) imide end-capped with pyromellitic anhydride and chain extended with methylene di-o-chloroaniline in dimethylformamide. The solution was cast onto a porous teflon support, dried at 70° C. for 24 hours and at 120° C. for 20 hours. It was then cured at 260° C. for 10 minutes.

TABLE 3

AROMATICS REMOVAL FROM A STRAIGHT RUN HIGH NAPHTHALENE CONTENT FEED

| | A Polyester (succinate) imide Membrane Under Pervaporation Conditions | | |
|---|---|---|---|
| Membrane: | Feed | Permeate | Enrichment Factor |
| Wt % Component: | | | |
| Toluene | 15.0 | 35.6 | 2.3 |
| Naphthalenes | 8.5 | 31.1 | 3.7 |
| 1-Ring Cycloparaffins | 29.3 | 16.4 | — |
| Paraffins | 47.2 | 16.9 | — |
| Total Aromatics | 23.5 | 66.7 | 6.5 |
| Flux, Kg/m2 · Day | 36.5 | | |
| Temperature, °C. | 210 | | |
| Pressure, mbar | 2.6 | | |
| Membrane Thickness, micron | 11.4 | | |

In this case, naphthalene removal from a straight-run feed does not occur with very high selectivity. The enrichment factors obtained for the aromatic components were moderately high, but none was particularly outstanding with respect to the others. Membrane performance for naphthalene removal does not depend simply on total aromatics concentration, but also on the 2+ ring aromatics concentration.

On comparing this example with Example 1, the total aromatics concentration in this feed and in the Varsol were similar (23.5 wt% in the gas oil and 20-21 wt% in the Varsol), but membrane performance was very different. The major difference between the two feeds was the low 2+ring aromatics (specifically naphthalene) content of the Varsol.

EXAMPLE 4

In this Example the feed to the pervaporation unit was the vacuum distillation overhead cut from an oily condensate stream and has not gone through any catalytic processing such as cat cracking or reforming). The oily condensate was a very wide boiling fraction, 90°-430° C. The vacuum distillate cut taken from this fraction is described as follows:

Nominal Hivac cut temperature: 320° C. (corrected to Atmospheric Pressure)

GCD: initial boiling point 89° C. mid boiling point 266° C. final boiling point 379° C.

Pervaporation was carried out using a polyester (adipate) imide membrane (prepared as described below) and a polyester (succinate) imide membrane (prepared as generally described in Example 1).

The polyester (adipate) imide membrane was prepared from 2000 molecular weight polyethyleneadipate endcapped with pyromellitic anhydride (4 hours at 140°-145° C.). It was chain-extended with 4,4'-methylenedianiline in an acetone/dimethylformamide mixture (25/75, w/w). The components were used in a 1:2:1 mole ratio. The polymer was then washcoated onto the previously described porous teflon support (Gore K-150 Teflon), dried and then cured at 260° C. for 12 minutes. To aid in coating, 0.5 wt% Zonyl FSN Fluorosurfactant (DuPont) was added to the polymer.

The polyester (succinate) imide membrane was prepared using a 1:2:1 molar ratio. 2000 molecular weight polyethylenesuccinate was endcapped with pyromellitic anhydride (5.5 hours at 160° C. and chain extended with 4,4'-methylene dianiline in a 25/75 w/w acetone/dimethylformamide mixture. Several coats were then wash coated onto Gore K-150 teflon on nowover polyester with curing at 260° C. for 12 minutes between coats. To aid in coating 0.35 wt% fluorosurfactant (Zonyl FSN, DuPont) was added to the polymer dope.

Permeate characteristics were as follows in Table 4.

TABLE 4

Aromatics Removal From A Straight-Run Low Naphthalene Content Feed Using Polyester Imide Membranes

| Membrane | Feed, wt % | PEI adipate SF | PEI adipate EF | PEI succinate SF | PEI succinate EF |
|---|---|---|---|---|---|
| cycloparaffins | 34.6 | 1.7 | — | 2.2 | — |
| alkylbenzenes | 10.7 | 5.2 | 1.8 | 11.3 | 2.0 |
| Indane/Tetralins | 3.9 | 5.3 | 1.9 | 7.8 | 1.4 |
| Indene | 3.7 | 6.1 | 2.2 | 12.5 | 2.2 |
| Naphthalene | <0.1 | >37 | >13.0 | >100 | >21 |
| C11+ Naphthalenes | 9.1 | 7.5 | 2.7 | 19.0 | 3.4 |
| Acenaphthenes | 4.4 | 3.3 | 1.2 | 9.3 | 1.6 |
| Acenaphthalenes | 2.5 | 3.6 | 1.3 | 10.6 | 1.9 |
| 3+ Ring aromatics | 2.7 | 1.9 | 0.7 | 4.4 | 0.8 |
| Paraffins | 28.3 | — | — | — | — |
| Total Aromatics | | | | | |
| Total aromatics concentration of permeate, wt % | | 70.8 | | 81.5 | |
| Flux, Kg/m2 · Day | | 190 | | 36.5 | |
| Temperature, °C. | | 175 | | 175 | |
| Pressure, mbar | | 2 | | 1 | |
| Overall Selectivity Factor, total aromatics/sats | | 4.0 | | 7.5 | |
| Amount of feed permeated (permeate yield wt %) | | — | | — | |

Component Selectivity Factor (SF) (by mass spectrometry calculated relative to paraffins) and Enrichment factors (EF).

EXAMPLE 5

Another run was performed using two different heavy cat naphtha (HCN) fractions as feed in pervaporation processes employing polyester (adipate) imide membranes, prepared as described in Example 2.

In the first run the HCN was a 320°-380° F. fraction. The pervaporation process was run at 140° C. at 10 mm Hg pressure. The feed analysis, permeate analysis selectivity factors and enrichment factors are presented in Table 5A below:

TABLE 5A

Aromatics Removal From a Cracked Feed (320–380° F. Fraction) of Low Naphthalene Content Using a Polyester (adipate) Imide Membrane

| Wt % | Feed | Permeate | Selectivity Factor(*) | Enrichment Factor |
|---|---|---|---|---|
| Permeate yield on feed, wt % | — | 19.0 | | |
| Benzenes | 46.5 | 77.6 | 5.0 | 1.7 |
| Naphthalenes | 0.3 | 0.7 | 7.1 | 2.3 |
| Cycloparaffins | 31.9 | 14.6 | — | — |
| Paraffins | 21.3 | 7.1 | | |
| Total Aromatics | 46.8 | 78.3 | 5.0 | 1.7 |
| Flux, Kg/m2 · Day | — | 201 | — | |

The membrane was 5.5 microns thick
(*)Selectivity factor with respect to paraffins In the second run a 380°–430° F. HCN fraction was used. Membrane and process conditions are the same as in the first run above. Feed and permeate analysis, selectivity factors and enrichment factors are presented in Table 5B below:

TABLE 5B

Aromatics Removal From a Cracked Feed (380–430° F. Fraction) of Low Naphthalene Content Using a Polyester (adipate) Imide Membrane

| Wt % | Feed | Permeate | Selectivity Factor(*) | Enrichment Factor |
|---|---|---|---|---|
| Permeate yield on feed, wt % | — | 13.5 | | |
| Benzenes | 47.6 | 71.4 | 4.9 | 1.5 |
| Naphthalenes | 5.4 | 10.8 | 6.5 | 2.0 |
| Cycloparaffins | 23.5 | 10.6 | — | — |
| Paraffins | 23.5 | 7.2 | — | |
| Total Aromatics | 53.0 | 82.2 | 5.1 | 1.6 |
| Flux, Kg/m2 · Day | — | 154 | — | |

The membrane was 5.5 microns thick
(*)Selectivity factor with respect to paraffins These examples show that in addition to total aromatics content and naphthalene content, the inherent nature of the feed exerts a controlling influence on the ability of polyester imide membrane to selectively and disproportionately permeate naphthalene.

In run 1 the feed contained 0.26 wt% naphthalene which, according to the earlier examples (Examples 1 and 4) would have led one to assume that the pervaporation process would demonstrate unexpectedly high naphthalene selectivity. However, in Table 5A it is seen that no such unexpectedly high naphthalene selectivity is obtained. The same is seen from Table 5B wherein a feed containing 5.5 wt% naphthalene also did not yield unexpectedly high naphthalene selectivity. Thus it is seen that low naphthalene concentration and low aromatics concentration are not sufficient to achieve the desired result. The feed to the permeation process must also be a straight run distillate, that is, the feed cannot have been subjected to any catalytic molecular management process such as cat cracking, hydrotreating, or reforming.

What is claimed is:

1. A method for the selective removal of 2-ring aromatics from straight run hydrocarbon distillate feed streams which contain about 3 wt% or less of said 2-ring aromatics, said process comprising contacting said hydrocarbon feed stream with one side of a polyesterimide membrane under pervaporation conditions thereby producing a permeate enriched in 2-ring aromatic hydrocarbons and a retentate of reduced 2-ring aromatic content as compared to the hydrocarbon feed.

2. The process of claim 1 wherein the 2-ring aromatic hydrocarbons comprise naphthalene, $C_1$ and $C_2$ substituted naphthalene.

3. The process of claim 2 wherein the 2-ring aromatic hydrocarbons comprise mixtures of naphthalene and $C_1$ and $C_2$ substituted naphthalene.

4. The process of claim 1 wherein the straight run hydrocarbon distillate feed contains about 40 wt% or less total aromatics.

5. The process of claim 1 wherein the polyester-imide membrane is a polyester(adipate)-imide membrane or a polyester-(succinate)-imide membrane.

* * * * *